US009135816B2

(12) United States Patent
Chung

(10) Patent No.: US 9,135,816 B2
(45) Date of Patent: Sep. 15, 2015

(54) INTELLIGENT LASER TRACKING SYSTEM AND METHOD FOR MOBILE AND FIXED POSITION TRAFFIC MONITORING AND ENFORCEMENT APPLICATIONS

(75) Inventor: Jiyoon Chung, Aurora, CO (US)

(73) Assignees: Laser Technology, Inc., Centennial, CO (US); Kama-Tech (HK) Limited, Tsim Sha Tsui, Hong Kong (CN)

( * ) Notice: Subject to any disclaimer, the term of this patent is extended or adjusted under 35 U.S.C. 154(b) by 838 days.

(21) Appl. No.: 13/228,250

(22) Filed: Sep. 8, 2011

(65) Prior Publication Data

US 2013/0066542 A1 Mar. 14, 2013

(51) Int. Cl.

| | |
|---|---|
| ***G08G 1/04*** | (2006.01) |
| ***G08G 1/052*** | (2006.01) |
| ***G08G 1/054*** | (2006.01) |

(52) U.S. Cl.

CPC ..... *G08G 1/04* (2013.01); *G08G 1/052* (2013.01); *G08G 1/054* (2013.01)

(58) Field of Classification Search

CPC ..... G08G 1/0104; G08G 1/096716; G08G 1/096775; G08G 1/04; G08G 1/052; G08G 1/054; G01C 21/3492; G06G 7/76; F41G 3/06; F41G 3/12; F41G 3/165; F41G 3/22

USPC ..... 701/117, 119; 42/90, 119; 340/937; 342/115; 348/148; 356/28; 382/103; 396/419; 89/41.06

See application file for complete search history.

(56) References Cited

U.S. PATENT DOCUMENTS 4,815,757 A * 3/1989 Hamilton ..... 280/764.1
5,528,246 A * 6/1996 Henderson et al. ..... 342/115
5,680,123 A * 10/1997 Lee ..... 340/937
5,902,351 A 5/1999 Streit et al.
5,948,038 A * 9/1999 Daly et al. ..... 701/117
6,639,998 B1 * 10/2003 Lee et al. ..... 382/103

(Continued)

FOREIGN PATENT DOCUMENTS

| | | |
|---|---|---|
| KR | 1020000038131 | 7/2000 |
| KR | 1020050048961 | 5/2005 |
| KR | 1020070121098 | 3/2008 |

OTHER PUBLICATIONS

PCT Notification of Transmittal of the International Search Report and The Written Opinion of the International Searching Authority, or the Declaration, PCT/US2012/054234, mailing date Feb. 27, 2013, pp. 11.

*Primary Examiner* — James Trammell
*Assistant Examiner* — James E Stroud
(74) *Attorney, Agent, or Firm* — William J. Kubida; Hogan Lovells US LLP; Peter J. Meza

(57) ABSTRACT

An intelligent laser tracking system and method for mobile and fixed position traffic monitoring and enforcement applications. The system disclosed herein can autonomously track multiple target vehicles with a highly accurate laser based speed measurement system or, under manual control via a touch screen, select a particular target vehicle of interest. In a mobile application the police vehicle speed is determined through the OBD II CAN port and updated for accuracy though an onboard GPS subsystem. The system and method of the present invention simultaneously provides both narrow and wide images of a target vehicle for enhanced evidentiary purposes. A novel, low inertia pan/tilt mechanism provides extremely fast and accurate target vehicle tracking and can compensate for geometrical errors and the cosine effect.

34 Claims, 9 Drawing Sheets

(56) References Cited

U.S. PATENT DOCUMENTS

| | | | | |
|---|---|---|---|---|
| 7,149,325 | B2 * | 12/2006 | Pavlidis et al. | 382/103 |
| 7,262,790 | B2 * | 8/2007 | Bakewell | 348/148 |
| 7,527,439 | B1 * | 5/2009 | Dumm | 396/419 |
| 2003/0214585 | A1 * | 11/2003 | Bakewell | 348/148 |
| 2007/0050139 | A1 * | 3/2007 | Sidman | 701/220 |
| 2009/0079960 | A1 * | 3/2009 | Chung | 356/28 |
| 2011/0025862 | A1 | 2/2011 | Lindsay | |

* cited by examiner

INTELLIGENT LASER TRACKING SYSTEM AND METHOD FOR MOBILE AND FIXED POSITION TRAFFIC MONITORING AND ENFORCEMENT APPLICATIONS

COPYRIGHT NOTICE/PERMISSION

A portion of the disclosure of this patent document contains material which is subject to copyright protection. The copyright owner has no objection to the facsimile reproduction by anyone of the patent document of the patent disclosure as it appears in the United States Patent and Trademark Office patent file or records, but otherwise, reserves all copyright rights whatsoever. The following notice applies to the pseudo code described herein, inclusive of the drawing figures where applicable: Copyright© 2011, Laser Technology, Inc.

BACKGROUND OF THE INVENTION

The present invention relates, in general, to the field of traffic monitoring and enforcement systems. More particularly, the present invention relates to an intelligent laser tracking system and method for mobile and fixed position traffic monitoring and enforcement applications.

Police have been using radar and laser speed measurement devices to determine vehicle speed in traffic enforcement operations for many years now. With respect to radar based devices, they generally function such that a microwave signal is emitted toward a moving vehicle and a reflection from the target returned to the device which then uses the determined Doppler shift in the return signal to determine the vehicle's speed. Radar based devices have an advantage over laser based speed guns in that they emit a very broad signal cone of energy and do not therefore, require precise aiming at the target vehicle. As such, they are well suited for fixed and mobile applications while requiring little, if any, manual operator aiming of the device.

On the other hand, laser based speed guns employ the emission of a series of short pulses comprising a very narrow beam of monochromatic laser energy and then measure the flight time of the pulses from the device to the target vehicle and back. These laser pulses travel at the speed of light which is on the order of 984,000,000 ft/sec. or approximately 30 cm/nsec. Laser based devices then very accurately determine the time from when a particular pulse was emitted until the reflection of that pulse is returned from the target vehicle and divide it by two to determine the distance to the vehicle. By emitting a series of pulses and determining the change in distance between samples, the speed of the vehicle can be determined very quickly and with great accuracy.

Because of the narrow beam width of laser based speed guns, they have heretofore been predominantly relegated to hand held units which must be manually aimed at a specific target vehicle. That being the case, they have not been able to be employed in autonomous applications wherein an operator is not manually aiming the device. Further, in mobile applications wherein the officer may be driving a vehicle himself, he is then unable to divert his attention from that function in order to track and aim a laser based speed measurement device at a suspected speeder let alone track multiple targets.

In fixed and semi-fixed uses of laser based speed detection devices, such as overpass mounted applications, it is important that the laser pulses be directed to a single point on an approaching target vehicle inasmuch as the frontal surface angles can vary between, for example, that of the grille ($\theta_1$) and the windshield ($\theta_2$) Where the distance to the target vehicle as measured by the laser based device is a distance M at an angle $\phi$ and the true distance to the target is D, D is then equal to $M*(\cos\phi+\sin\phi/\tan(\theta_1 \text{ or } \theta_2))$.

Thus, the true distance D can vary, and hence the calculated speed of the target vehicle. Normally, the angle $\phi$ is less than 10° and $\cos\phi$ is then almost 1. This can reduce the calculated speed of the target vehicle, in effect giving a 1% to 2% detected speed advantage to the target vehicle as indicated below with respect to the "cosine effect". However, the cosine effect can be minimized if an accurate tracking trajectory is maintained. On the other hand, it should be noted that the value of $\sin\phi/\tan(\theta_1 \text{ or } \theta_2)$ can be greater than a normally acceptable error margin (e.g., 0.025 (2.5%)) and an even larger error can be encountered if the laser pulses are not consistently aimed at a single point on the target vehicle. As used herein, the $\sin\phi/\tan(\theta_1 \text{ or } \theta_2)$ portion of the equation is referred to as a geometric error.

Both radar and laser based speed measurement devices can be used to measure the relative speed of approaching and receding vehicles from both fixed and mobile platforms. If the target vehicle is traveling directly (i.e. on a collision course) toward the device, the relative speed detected is the actual speed of the target. However, as is most frequently the case, if the vehicle is not traveling directly toward (or away from) the device but at an angle ($\alpha$), the relative speed of the target with respect to that determined by the device will be slightly lower than its actual speed. This phenomenon is known as the previously mentioned cosine effect because the measured speed is directly related to the cosine of the angle between the speed detection device and the vehicle direction of travel. The greater the angle, the greater the speed error and the lower the measured speed. On the other hand, the closer the angle ($\alpha$) is to 0°, the closer the measured speed is to actual target vehicle speed.

SUMMARY OF THE INVENTION

The present invention advantageously provides an intelligent laser tracking system and method for mobile and fixed position traffic monitoring and enforcement applications. The system disclosed herein can autonomously track multiple target vehicles with a highly accurate laser based speed measurement system or, under manual control via a touch screen, select a particular target vehicle of interest.

The system of the present invention provides extremely accurate tracking of target vehicles using a novel and extremely fast pan/tilt mechanism which is stabilized through the use of an onboard gyro and inclinometer. The pan/tilt mechanism utilizes respective pan and tilt brushless DC (BLDC) motors which provide high torque and efficiency. The relatively heavy motors are mounted to the pan/tilt mechanism base plate to minimize inertia and lower the mass of the moving pan and tilt plates to which the laser rangefinder of the high performance laser speed measurement subsystem and the visual sensor subsystem are affixed.

In a mobile implementation of the present invention, the police vehicle in which the system is mounted has its own speed uploaded to the system via the vehicle's onboard diagnostic (OBD II) controller area network (CAN) port. Increased accuracy of this information is assured through updating of the police vehicle's speed through appropriate application of a global positioning system (GPS) subsystem to correct speed data for tire wear and pressure. Conveniently, the system of the present invention can be mounted within a standard police vehicle light bar enclosure or in other locations to provide both a forward and rearward view of traffic.

The intelligent laser tracking system of the present invention also assures that the laser is consistently aimed at a single specific point on the target vehicle to obviate geometric errors. Moreover, the system and method of the present invention can accurately compensate for the cosine effect when the target vehicle is moving at an angle with respect to the system.

In addition to mobile embodiments of the present invention for use in a police vehicle, the system of the present invention can also be mounted on a tripod or other fixture in a fixed or stationary location adjacent one or more lanes of vehicle traffic while still providing accurate targeting of multiple target vehicle speeds, distances and angles.

The image sensors of the present invention provide both wide and narrow views of target vehicles simultaneously as well as providing motion clips for evidentiary purposes and substantiation of vehicle speed. In a representative embodiment disclosed herein, the narrow view and wide view images can be obtained using dual sensors, lenses and an associated multiplexer. A dual multiplexed camera system is capable of achieving a fast transition between both narrow and wide views. Optionally, if a single lens system is implemented, lens control of the system camera can be provided for zoom, iris and focus functions. Remote monitoring of the system is possible through an input/output (I/O) interface such as Ethernet, WiFi, serial interfaces such as RS232/485, universal serial bus (USB) and the like. The image sensors employed in the system can be remote or fully integrated and remote monitoring functionality is also provided.

In addition to the aforementioned uses of the system of the present invention for target vehicle speed monitoring, the system can also be used to augment roadside police officer safety in such applications as construction zone and area scanning for collision avoidance and the like. Moreover, the system of the present invention can also be employed as a low cost three dimensional (3D) scanner for pile volume calculation, jetway positioning for aircraft, accident reconstruction and other applications.

Particularly disclosed herein is a tracking system comprising a processor, a visual sensor subsystem coupled to the processor and a laser speed measurement subsystem also coupled to the processor. A pan/tilt subsystem is coupled to the processor and movably supports the visual sensor and laser speed measurement subsystems.

Also particularly disclosed herein is a system for monitoring the speed of one or more target vehicles comprising a processor, a laser speed measurement subsystem coupled to the processor and a visual sensor subsystem coupled to the processor. A pan/tilt subsystem is also coupled to the processor and is operative to autonomously track one or more of the target vehicles based on input from the visual sensor subsystem. The system determines the speed of the one or more target vehicles based on input from the laser speed measurement subsystem.

BRIEF DESCRIPTION OF THE DRAWINGS

The aforementioned and other features and objects of the present invention and the manner of attaining them will become more apparent and the invention itself will be best understood by reference to the following description of a preferred embodiment taken in conjunction with the accompanying drawings, wherein.

DESCRIPTION OF A REPRESENTATIVE EMBODIMENT

Figure 1:
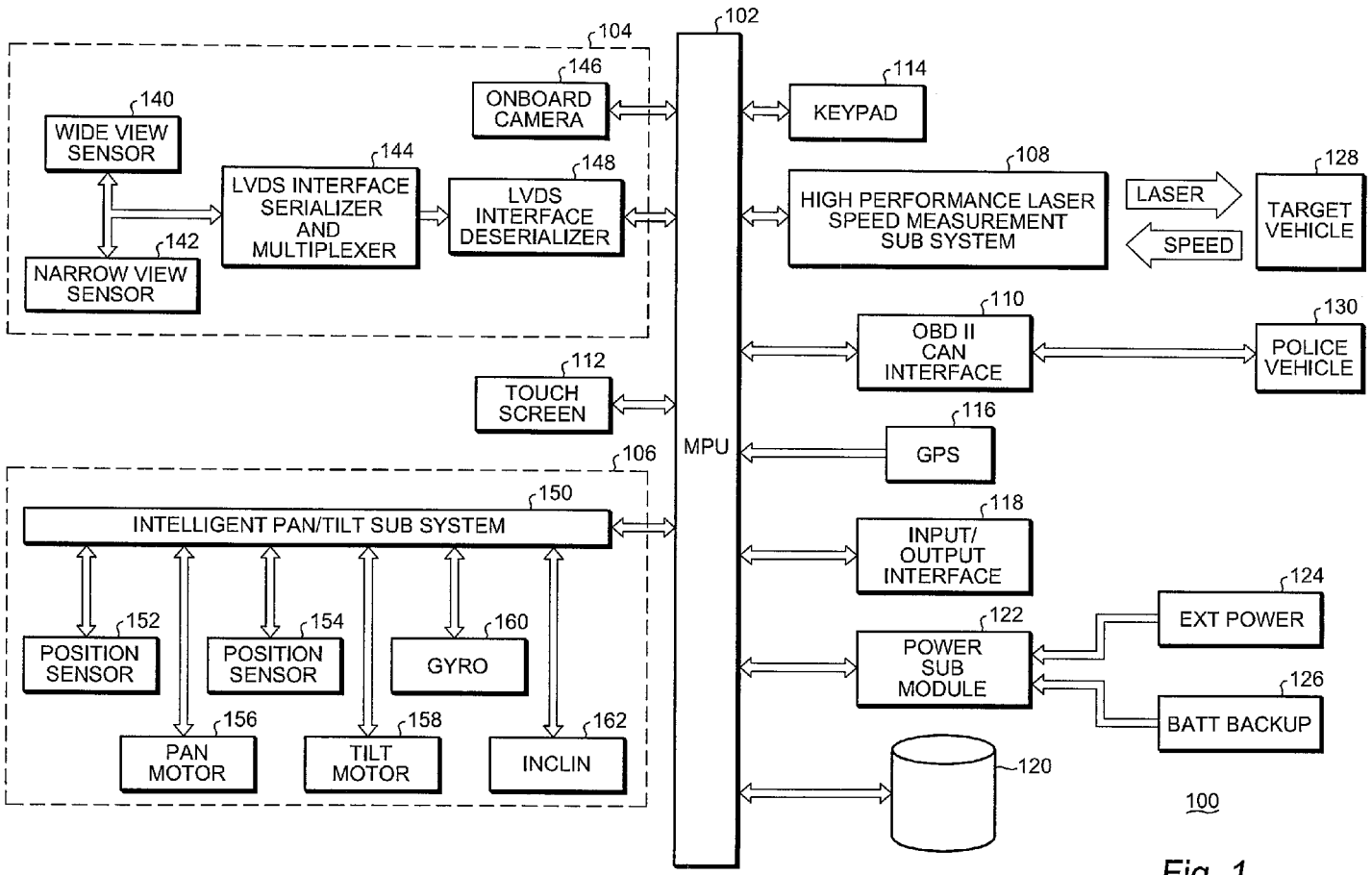
FIG. 1 is a high level functional block diagram of a representative embodiment of the intelligent laser tracking system and method for mobile traffic monitoring and enforcement applications of the present invention.

With reference now to FIG. 1, a high level functional block diagram of a representative embodiment of the intelligent laser tracking system for mobile traffic monitoring and enforcement applications of the present invention is shown. The system 100 comprises a central processing unit (CPU), microcontroller (MCU) or microprocessor (MPU) 102 which, in a representative embodiment, may comprise one of the 600 MHz OMAP 34xx, 35xx or 36xx series of high performance application processors available from Texas Instruments, Inc.

A visual sensor subsystem 104 is bidirectionally coupled to the MPU 102 by one or more image buses as illustrated to which an intelligent pan/tilt subsystem 106 is also bidirectionally coupled. The visual sensor subsystem 104 may be made physically detachable from the rest of the unit if desired. A high performance laser speed measurement subsystem 108 is also bidirectionally coupled to the MPU 102 to provide distance and speed measurement data between the system 100 and a target vehicle 128.

An on-board diagnostic II (OBD II)/controller area network (CAN) interface 110 to a vehicle diagnostic port (e.g. in a police vehicle 130) is also coupled to the MPU 102 as well as a touch screen 112 for operator viewing and input. The touch screen 12 may also be made detachable from the rest of the unit if desired. A global positioning system (GPS) subsystem 116 also provides input to the MPU 102 while an input/output (I/O) interface 118, such as an Ethernet port, WiFi, serial port (e.g. RS232/485), universal serial bus (USB) or other interface couples external devices to the system 100 through MPU 102.

Back-up storage for the system 100 may be provided by means of a storage device 120 such as an SD card or similar non-volatile storage devices whether removable or otherwise. The system 100 is powered through a power submodule 122 which may comprise the operating vehicle electrical system in a mobile embodiment of the present invention, an external power supply (e.g. an automobile battery or generator) 124 and/or a battery back-up system to prevent data loss such as a 7.2 volt lithium ion (Li-Ion) battery 126.

The visual sensor subsystem 104 comprise, in a representative embodiment of the present invention a 5.0 megapixel image sensor functioning as a wide view camera 140 and another 5.0 megapixel image sensor functioning as a narrow view camera 142. These two sensors are coupled to the input of a low-voltage differential signaling (LVDS) interface and multiplexer 144 functioning as a data serializer which, in turn, is coupled over a two-wire connection to an LVDS interface deserializer 148 for the wide view and narrow view sensors 140,142 functioning as remote camera devices. In order to toggle between narrow to wide (or wide to narrow) views, the remote camera block (140 and 142) would have an associated multiplexer to select one camera input at a time. An onboard camera 146 is also coupled to the MPU 102 which, in a representative embodiment, may comprise a 5.0 megapixel complementary metal oxide (CMOS) image sensor.

The intelligent pan/tilt subsystem 106 comprises, in pertinent part a bidirectional bus 150 to which a pair of position sensors 152 and 154 are coupled in addition to a gyro 160 and inclinometer 162. It should be noted that, as used herein, the function of the inclinometer 162 can also be performed by, for example, an accelerometer. The positions sensors 152 and 154 are respectively associated with the intelligent pan/tilt subsystem 106 pan motor 156 and tilt motor 158. The operation and functional elements of the intelligent pan/tilt subsystem 106 will be more fully described hereinafter.

Figure 2A:
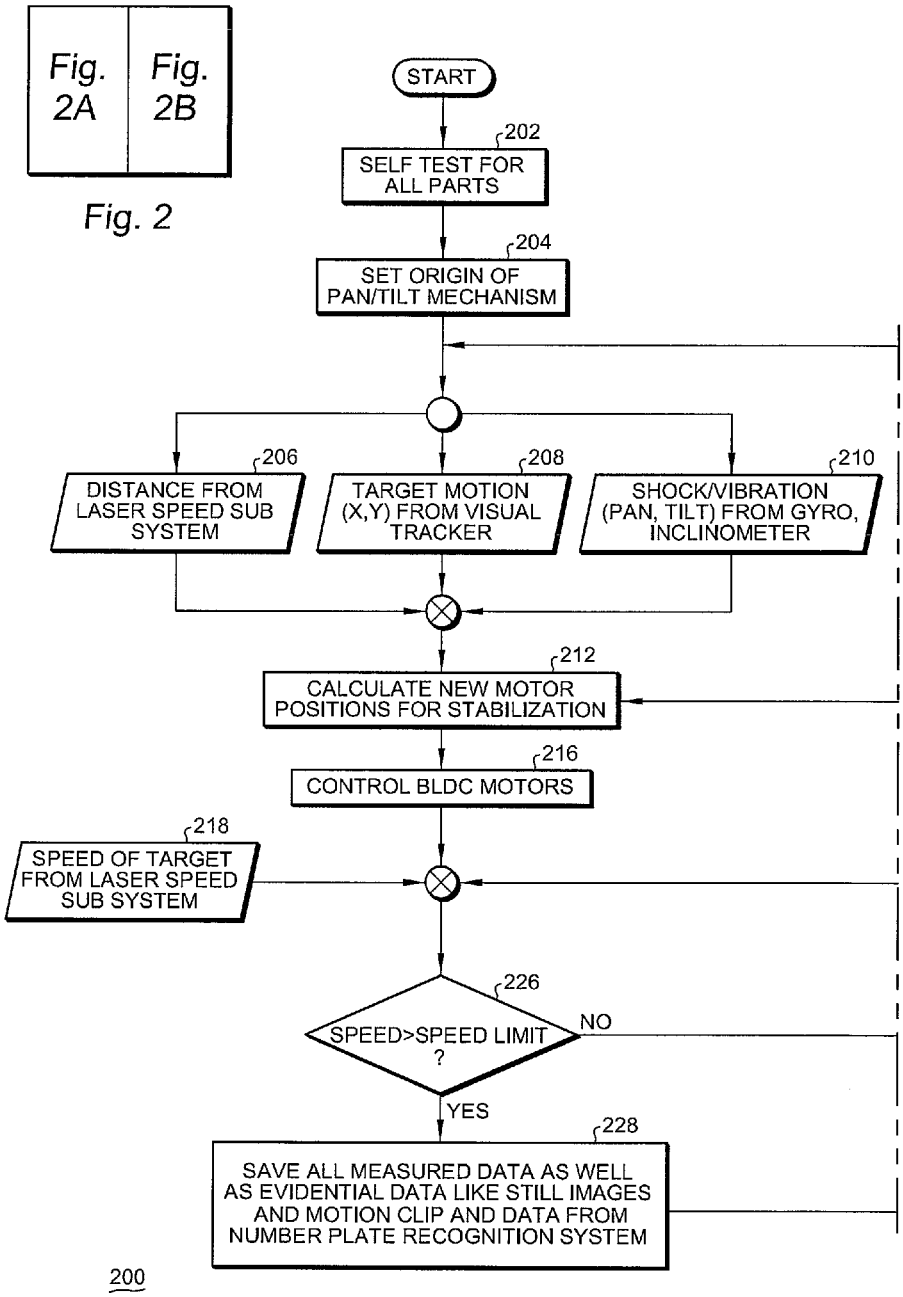
FIGS. 2A and 2B are a representative logic flow diagram for possible implementation in accordance with the system and method of the preceding figure.
Figure 2B:
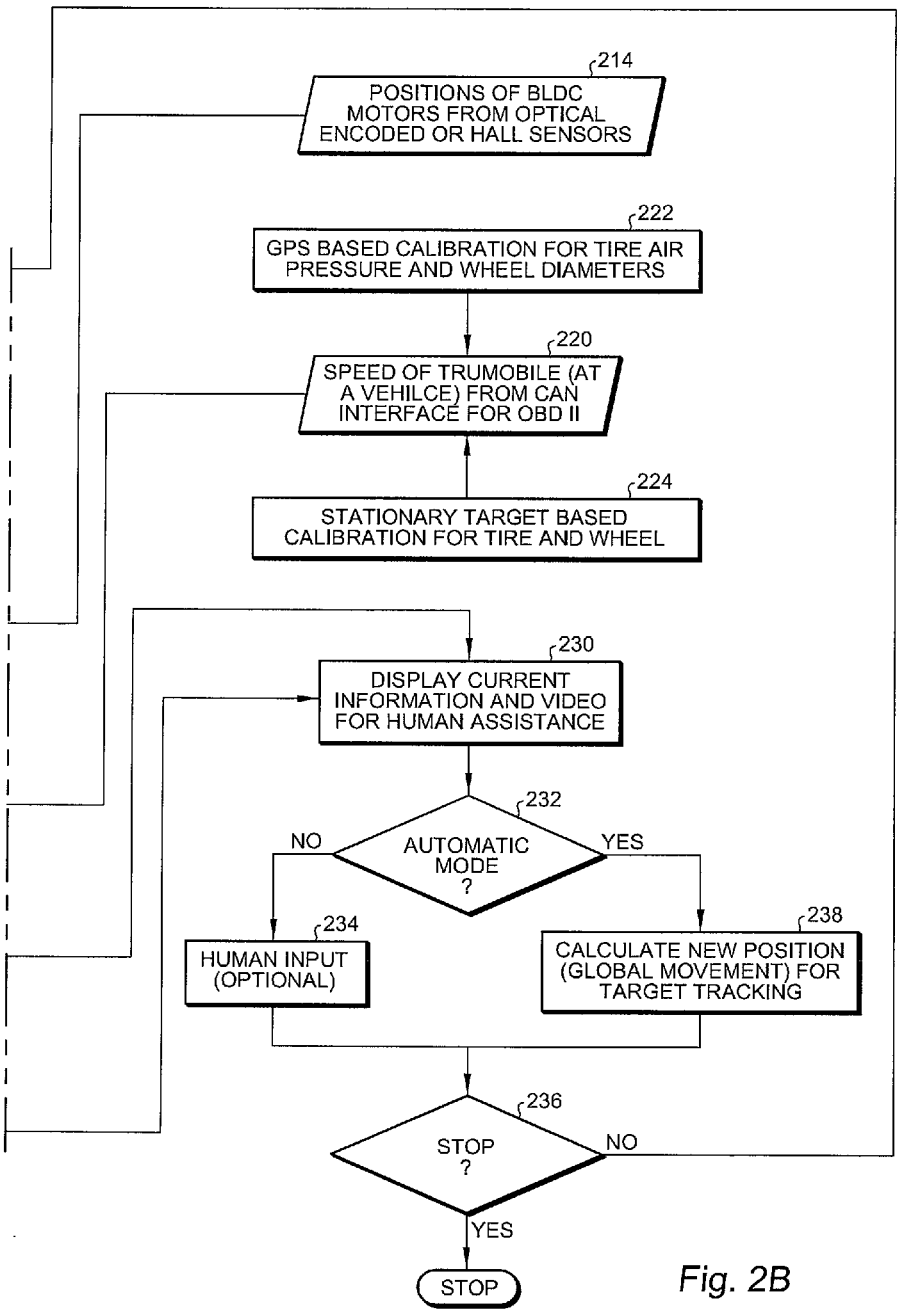

With reference additionally now to FIGS. 2A and 2B, a representative logic flow diagram for possible implementation in accordance with the system of the preceding figure is shown in the form of process 200. The process 200 begins with a self-test step 202 for all of the system 100 components followed by the setting of the origin position of the intelligent pan/tilt subsystem 106 and step 204.

At this point the distance between the system 100 (for example, as mounted in a police vehicle 130) and a target vehicle 128 is determined at step 206 by the high performance laser speed measurement subsystem 108. In a preferred embodiment, the laser speed measurement subsystem 108 may comprise a TruSense™ S200 laser sensor available from Laser Technology, Inc., assignee of the present invention which provides up to 200 distance measurements per second. The distance information provided by the laser speed measurement subsystem 108 may be utilized to augment the visual sensor subsystem 104 and to resolve any ambiguities that might arise due to an inability to distinguish, for example, a dark colored license plate from shading due to poor lighting conditions.

At step 208, the motion of the target vehicle 128 with respect to the system 100 is determined in Cartesian coordinates (x,y) on an image plane. This may be effectuated in the following manner:

1. An image (240×180 pixels) of the target vehicle 128 is grabbed by the CMOS image sensor of either the onboard camera 146 or the remote cameras 140 or 142;

2. Features of the image are extracted. This may be effectuated through the use of optic flow in which the direction of movement of each pixel from one image to the next is determined. Among the processes which may be used in this regard include those described in a Wikipedia wiki on Optical flow or the use of edges (such as a Sobel operation) or those described in a Wikipedia wiki on Edge detection.

3. The extracted features are segmented to produce an object. This may be effectuated by the grouping of pixels which have a similar direction or fuzzy logic and/or a neural network may be employed for segmenting the pixels.

4. The center of mass of the objects is tracked and estimated. This can be accomplished through the use of a Kalman filter as described in a Wikipedia wiki on Kalman filters; and 5. The estimated position (x,y) can be used for the target motion (x,y).

At step 210, the shock and vibration experienced by the system 100 due to the possible motion of the police vehicle 130 is determined such that it can be filtered out. In this regard, the outputs of the gyro 160 and inclinometer 162 are sampled on the order of every millisecond or less. In a representative embodiment of the present invention, 2047 samples/second are taken of the inclinometer 162 and 1000 samples/second of the gyro 160. As these devices tend to generate a great deal of noise, this must be filtered out. However, since relatively strong filters would lead to a slower signal response time the representative embodiment of the system 100 of the present invention implements a dual-stage adaptive low pass filter wherein:

For all measured data x[i], i=0 to n.

$$y1[i]=y1[i-1]-k1*(x[i]-y1[i-1])$$

$$y2[i]=y2[I-1]-k2*(x[i]-y2[I-1]),$$

where k1 and k2 are coefficients of the low pass filters.

y[i]=y1[i] if the difference between y1[i] and y2[i] is greater than a threshold, otherwise y2[i].

y[i] can provide very stable output from a strong low pass filter of y2[i] as well as much faster response time from the weaker low pass filter of y1[i].

At step 212, the information calculated in steps 206, 208 and 210 is used to calculate new motor positions for the pan motor 156 and tilt motor 158 of the pan/tilt subsystem 106 in conjunction with the positions of these brushless DC (BLDC) motors from an associated optical encoder or hall sensors at step 214. Thereafter at step 216 the pan motor 156 and tilt motor 158 are appropriately controlled.

At step 218, the speed of the target vehicle 128 is determined by the laser speed measurement subsystem 108 while at step 220 the speed of the system 100 as mounted in a police vehicle 130 is determined from its controller area network (CAN) interface to the vehicle's OBD II port. Inputs into this determination can be obtained from the GPS subsystem 116 at step 222 to provide correction for the police vehicle's tire pressure, wheel diameter and the like which might otherwise affect this calculation. It should be noted that GPS is usually very accurate if a vehicle is travelling with a constant speed and is otherwise less reliable. In the representative embodiment of the system 100 disclosed herein, the system 100 monitors the vehicle's speed primarily through the OBD II port and when this indicates a stable speed, tire condition is calibrated more correctly in conjunction with the GPS subsystem 116 data.

At step 224, a stationary target based calibration for the police vehicle 130 tire pressure and wheel diameters may be performed by aiming the system 100 at a stationary target such as a road sign or land feature. As the speed of such an object is zero, the system 100 can then calibrate tire condition. Utilizing the information and data computed previously, the system 100 then determines whether the target vehicle 128 speed is greater than the posted speed limit at decision step 226. If the speed of the target vehicle 128 is excessive, all previously measured data is saved in conjunction with evidentiary data such as still images and a motion video clip as recorded by the visual sensor subsystem 104 at step 228. In operation, the system 100 has determined the relative speed between the police vehicle 130 and the target vehicle 128 as well as the absolute speed of the system 100 itself as calibrated in conjunction with the GPS subsystem 116 (step 222) and/or stationary target evaluation (step 224). In a representative embodiment of the present invention, the system 100 may store two still images of the target vehicle 128, a wide view (e.g. on the order of 10 to 30 degrees to include contextual background information) and a narrow view (e.g. on the order of 5 to 20 degrees to include more detail of the target vehicle 128). A particular implementation of the present invention utilizes 100 mm and 30 mm focal length lenses in this regard. The motion clip can be saved from either the wide view or narrow view images and then stored to the storage device 120 which may be an SD card or the like or otherwise stored through the I/O interface 118 to a network through Ethernet or to an associated USB device. The captured still image may also be processed at step 228 by a number plate recognition system and its license number also stored with the other data.

At step 230, current information regarding the target vehicle 128 being tracked and information derived from the visual sensor subsystem 104 is displayed on the touch screen 112 whereupon the operator of the system 100 in the police vehicle 130 can direct certain system 100 functions. At decision step 232, if the operator determines to provide input to the process 200, such input can be provided at step 234. If the process 200 is to stop at decision step 236, then it reaches an end. Otherwise, the process 200 returns to the operations of steps 206, 208 and 210 as previously described. Alternatively, if the system 100 is to remain in automatic mode, then a new position is calculated for target vehicle 128 tracking at step 238 whereupon decision step 236 is again reached.

Figure 3A:
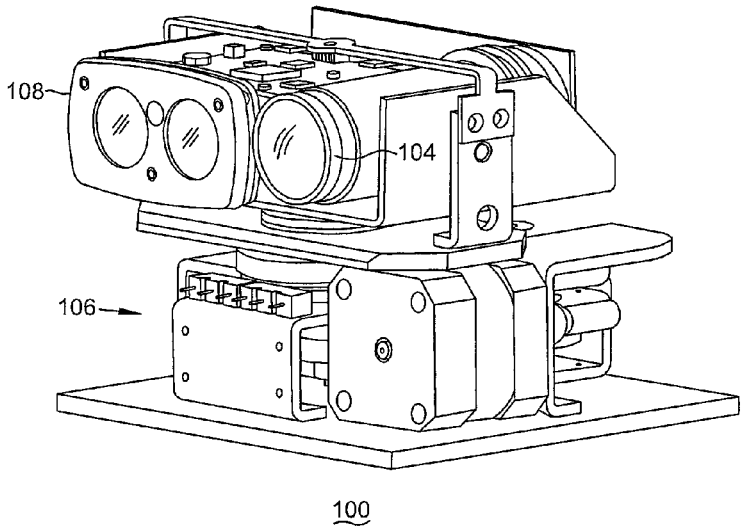
FIG. 3A is a front perspective view of an embodiment of the intelligent laser tracking system of the present invention illustrating the visual sensor subsystem, laser speed measurement subsystem and intelligent pan/tilt subsystem thereof.

With reference additionally now to FIG. 3A, a front perspective view of an embodiment of the intelligent laser tracking system 100 of the present invention is shown illustrating the visual sensor subsystem 104, laser speed measurement subsystem 108 and intelligent pan/tilt subsystem 106 thereof.

Figure 3B:
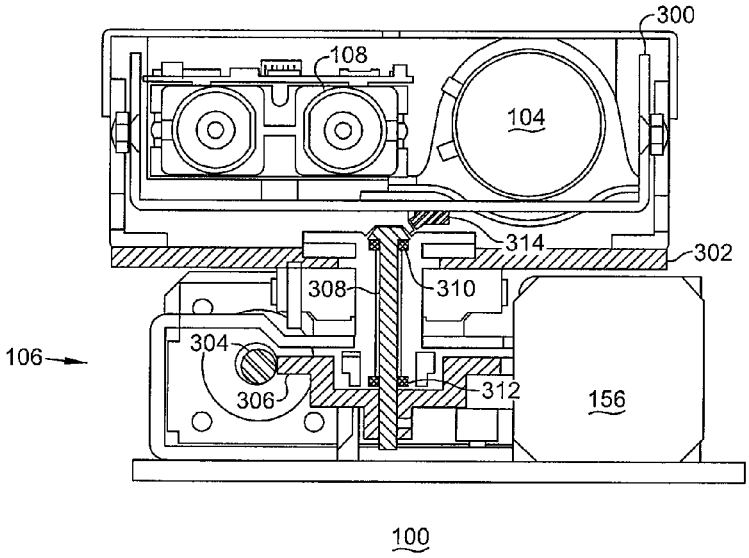
FIG. 3B is a partially cut-away front elevational view of the embodiment of the preceding figure illustrating the tilt plate and panning plate on which the visual sensor subsystem and laser speed measurement subsystem are controllably mounted including details of the tilt mechanism of the intelligent pan/tilt subsystem.

With reference additionally now to FIG. 3B, a partially cut-away front elevational view of the embodiment of the preceding figure is shown illustrating the tilt plate 300 and panning plate 302 on which the visual sensor subsystem 104 and laser speed measurement subsystem 108 are controllably mounted including details of the tilt mechanism of the intelligent pan/tilt subsystem 106.

The tilt plate 300 is pivotally mounted to the panning plate 302 to provide elevational motion for the visual sensor subsystem 104 and laser speed measurement subsystem 108. The panning plate 302 provides rotational motion for the same system 100 subsystems. A worm 304 driven by the tilt motor 158 in turn drives a worm gear 306 to drive a tilt shaft/pinion rotatably held by upper and lower tilt bearings 310, 312. The tilt shaft/pinion then drives a tilt gear 314 to pivotally provide up and down elevational motion to the tilt plate 300.

Figure 3C:
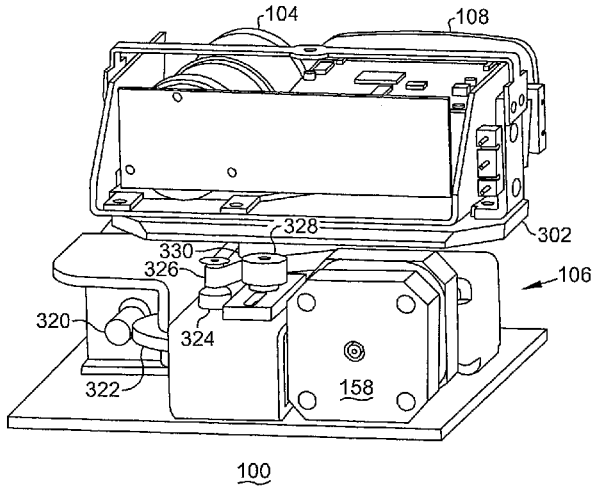
FIG. 3C is a rear perspective view of the embodiment of the preceding figures including details of the pan mechanism of the intelligent pan/tilt subsystem.

With reference additionally now to FIG. 3C, a rear perspective view of the embodiment of the preceding figures is shown including details of the pan mechanism of the intelligent pan/tilt subsystem 106. A worm 320 driven by the pan motor 156 drives a corresponding worm gear 322 to provide rotational motion to a panning pinion 324. The panning pinion 324 drives a belt 326 and idler pulley 328 to drive a panning gear 330 to provide rotational motion to the panning plate 302. Rotation of on the order of 320° or more is achievable.

The design of the intelligent pan/tilt subsystem 106 of the present invention minimizes the inertia of the system 100 by placing the heavier mass of the pan and tilt motors 156, 158 on a fixed base plate and not on any of the moving parts. The design of this aspect of the present invention provides a particularly efficacious and low-cost solution.

Figure 4:
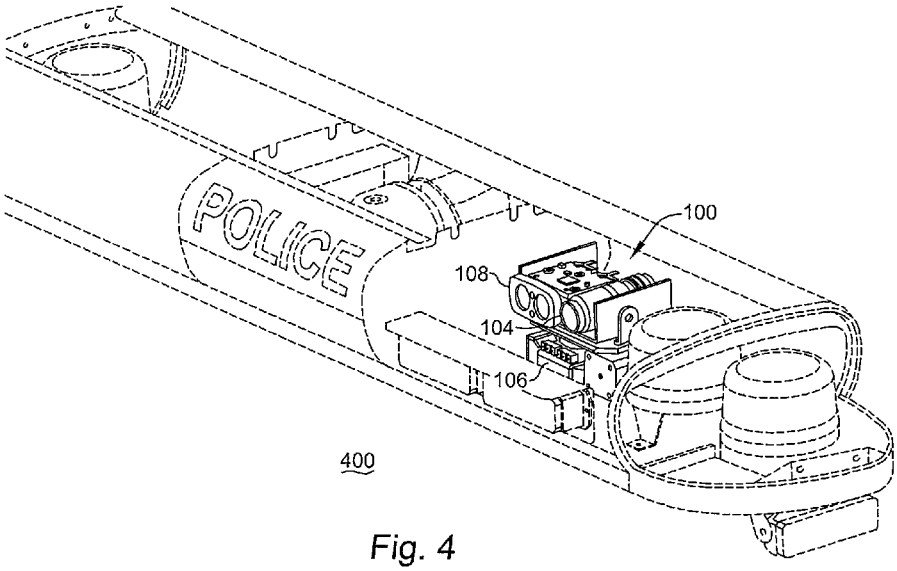
FIG. 4 is a partially cut-away view of a police vehicle light bar including the embodiment of the intelligent laser tracking system of the present invention illustrated in FIGS. 3A to 3C mounted therein to enable both forward and rearward views of vehicular traffic in a moving or stationary police vehicle.

With reference additionally now to FIG. 4, a partially cut-away view of a police vehicle light bar 400 is shown including the embodiment of the intelligent laser tracking system 100 of the present invention illustrated in FIGS. 3A to 3C mounted therein to enable both forward and rearward views of vehicular traffic in a moving or stationary police vehicle 130. It should be noted that the mounting of the system 100 in the light bar 400 of a police vehicle 130 is only one of the possible mounting configurations available and that the system 100 could similarly be mounted on the windshield, dashboard or behind the rear window of a police vehicle 130.

Figure 5A:
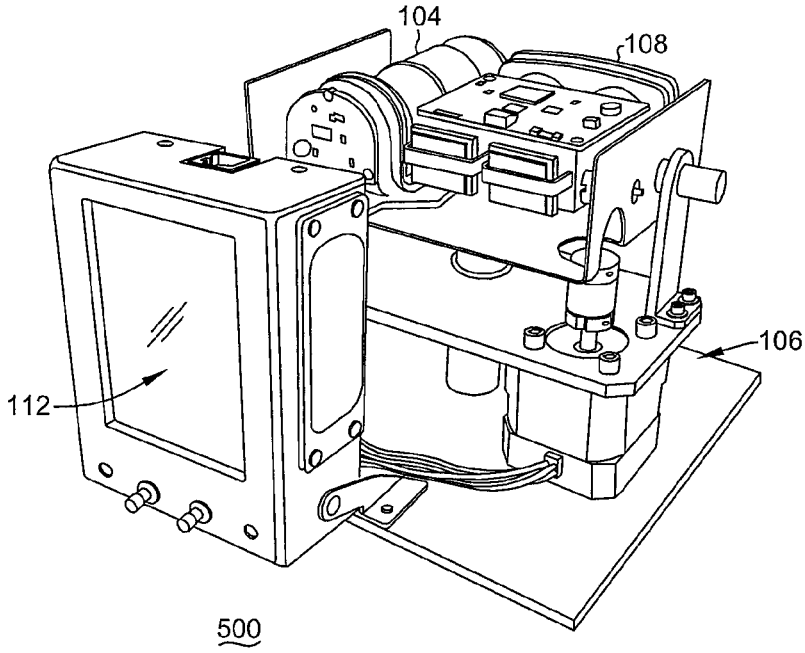
FIGS. 5A and 5B are respectively rear perspective and top perspective views of another embodiment of the intelligent laser tracking system of the present invention for possible stationary tripod mounted traffic monitoring applications.
Figure 5B:
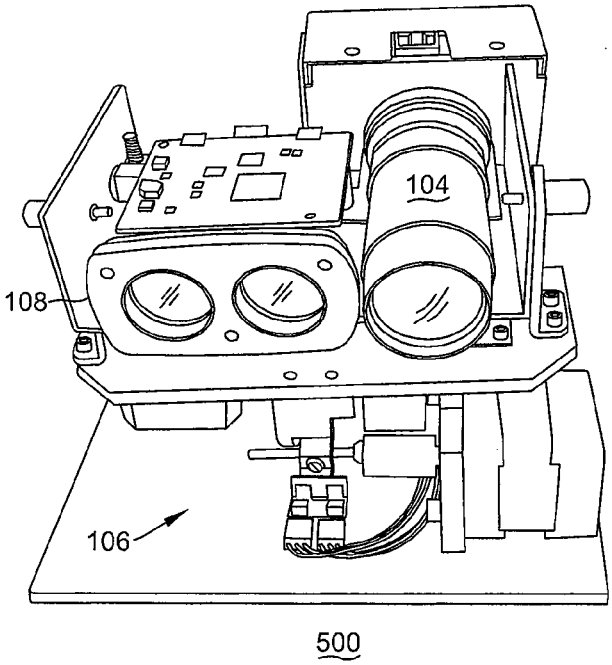

With reference additionally now to FIGS. 5A and 5B, respectively rear perspective and top perspective views of another embodiment 500 of the intelligent laser tracking system of the present invention are shown for possible stationary tripod mounted traffic monitoring applications. In this particular embodiment 500, alternative mounting and driving mechanisms are illustrated for providing pan and tilt motion for the visual sensor subsystem 104 and laser speed measurement subsystem 108. In addition, the touch screen 112 is shown as being physically mounted to the system 100 base plate.

Figure 6:
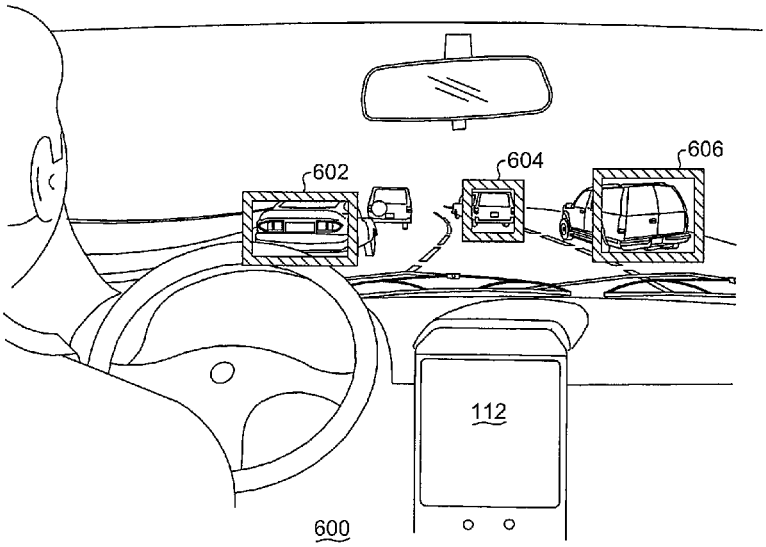
FIG. 6 illustrates the possible traffic monitoring function of a mobile embodiment of the intelligent laser tracking system of the present invention when mounted in a police vehicle in which the speed of multiple target vehicles may be autonomously tracked without operator input or manually overridden to select a certain vehicle as a target.

With reference additionally now to FIG. 6, the possible traffic monitoring function 600 of a mobile embodiment of the intelligent laser tracking system 100 of the present invention is shown when mounted in a police vehicle 130, such as in the light bar 400 of FIG. 4. In this application, the speed of multiple target vehicles 602, 604, and 606 may be autonomously tracked by the intelligent laser tracking system without operator input allowing the driver to devote his attention to driving. Alternatively, the system 100 may be manually over-ridden to select a certain vehicle as a target by tapping on a particular one of the target vehicles as viewed on the touch screen 112. For example, if the operator of the police vehicle where particularly interested in the speed of the Aston Martin Vanquish to his left, he can select that particular target vehicle 602 as the one to be tracked.

Figure 7:
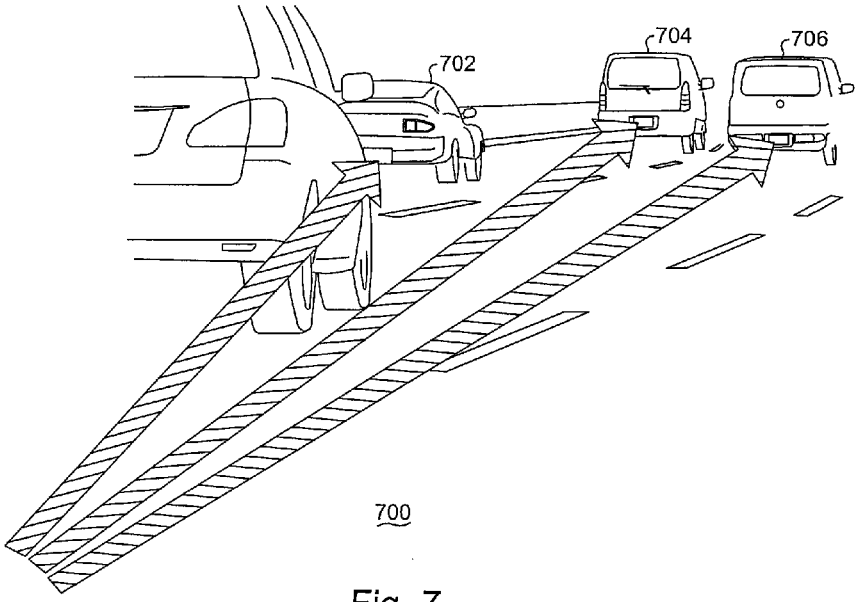
FIG. 7 illustrates the possible traffic monitoring function of a stationary embodiment of the intelligent laser tracking system of the present invention as it may be mounted on a tripod to automatically track and provide the speed of multiple target vehicles across multiple lanes of traffic.

With reference additionally now to FIG. 7, the possible traffic monitoring function 700 of a stationary embodiment of the intelligent laser tracking system 100 of the present invention is shown as it may be mounted on a tripod to automatically track and provide the speed of multiple target vehicles 702, 704 and 706 across multiple lanes of traffic using, for example, the embodiment of the present invention of FIGS. 5A and 5B. The intelligent laser tracking system 100 of the present invention for use in the traffic monitoring function 700 may function autonomously to track the speed of one or more of the target vehicles 702, 704 or 706 or an individual one of the target vehicles may be manually selected on the touch screen 112 (not shown).

Figure 8A:
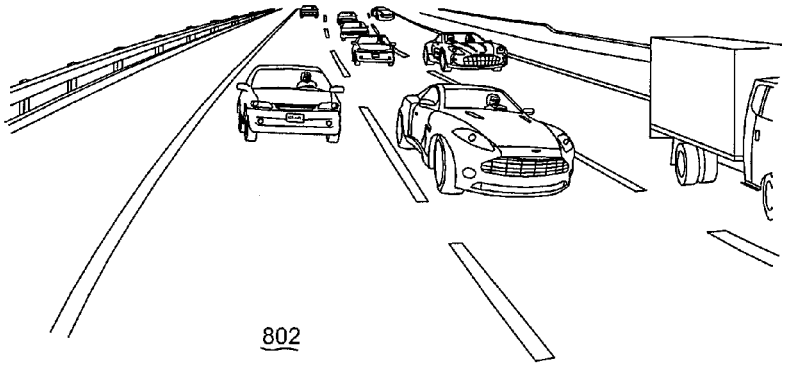
FIGS. 8A and 8B are representative wide views and narrow views respectively of the images of one or more target vehicles that are achievable through the use of the tightly integrated dual image sensors forming a portion of the visual sensor subsystem in a representative embodiment of the intelligent laser tracking system of the present invention.
Figure 8B:
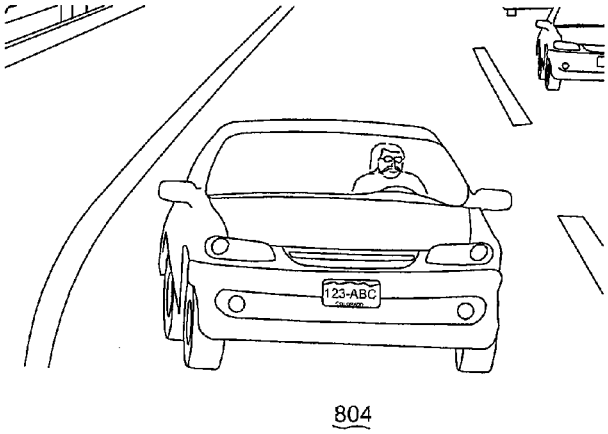

With reference additionally now to FIGS. 8A and 8B, representative wide views 802 and narrow views 804 respectively of the images of one or more target vehicles. Such images are achievable through the use of the tightly integrated dual image sensors comprising wide view sensor 140 and narrow view sensor 142 (FIG. 1) forming a portion of the visual sensor subsystem 104 in a representative embodiment of the intelligent laser tracking system 100 of the present invention. The wide view 802 provides surrounding context for the target vehicle at the time the image was captured while the narrow view 804 can be utilized to uniquely identify the vehicle by license plate number for either human or machine reading.

Figure 9A:
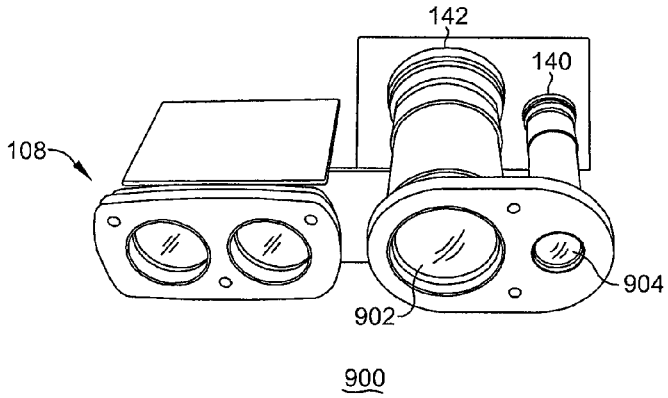
FIG. 9A is a top perspective view of a portion of an alternative embodiment of the system of the present invention illustrating the laser speed measurement subsystem and separate wide view and narrow view cameras.
Figure 9B:
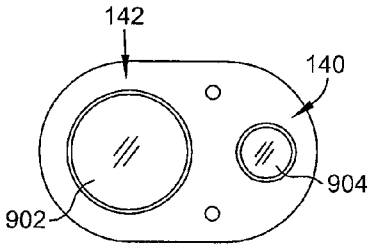
FIGS. 9B and 9C are respective front and rear views of the separate wide view and narrow view cameras of the preceding figure showing the lenses and associated sensors respectively.
Figure 9C:
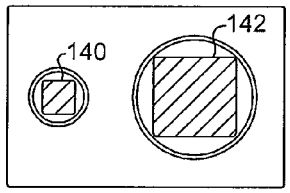

With reference additionally now to FIG. 9A, a top perspective view of a portion 900 of an alternative embodiment of the system 100 of the present invention is shown illustrating the laser speed measurement subsystem 108 and separate wide view and narrow view cameras. Referring also to FIGS. 9B and 9C, respective front and rear views of the separate wide view and narrow view cameras of the preceding figure are shown illustrating the lenses and associated sensors thereof respectively. The narrow view camera incorporates a lens 902 associated with narrow view sensor 142 while the wide view camera incorporates a lens 904 associated with wide view sensor 140. As previously described, in order to toggle between narrow to wide (or wide to narrow) views, the remote camera block (140 and 142) would have an associated multiplexer to select one camera input at a time.

While there have been described above the principles of the present invention in conjunction with specific circuitry and structure, it is to be clearly understood that the foregoing description is made only by way of example and not as a limitation to the scope of the invention. Particularly, it is recognized that the teachings of the foregoing disclosure will suggest other modifications to those persons skilled in the relevant art. Such modifications may involve other features which are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The applicants hereby reserve the right to formulate new claims to such features and/or combinations of such features during the prosecution of the present application or of any further application derived therefrom.

As used herein, the terms "comprises", "comprising", or any other variation thereof, are intended to cover a non-exclusive inclusion, such that a process, method, article, or apparatus that comprises a recitation of certain elements does not necessarily include only those elements but may include other elements not expressly recited or inherent to such process, method, article or apparatus. None of the description in the present application should be read as implying that any particular element, step, or function is an essential element which must be included in the claim scope and THE SCOPE OF THE PATENTED SUBJECT MATTER IS DEFINED ONLY BY THE CLAIMS AS ALLOWED. Moreover, none of the appended claims are intended to invoke paragraph six of 35 U.S.C. Sect. 112 unless the exact phrase "means for" is employed and is followed by a participle.

What is claimed is:

1. A tracking system for monitoring the speed of one or more target vehicles comprising:

a processor;

a visual sensor subsystem coupled to said processor;

a laser speed measurement subsystem coupled to said processor; and a pan/tilt subsystem responsive to said visual sensor subsystem coupled to said processor for autonomously movably supporting said visual sensor and laser speed measurement subsystems, said system determining a speed of said one or more target vehicles based on input from said laser speed measurement subsystem wherein said visual sensor subsystem is operative to identify one or more moving targets and cause said pan/tilt subsystem to aim said visual sensor subsystem and said laser speed measurement subsystem at said one or more moving targets; wherein said visual sensor subsystem is operative to cause said pan/tilt subsystem to aim said visual sensor subsystem and said laser speed measurement subsystem at each of said one or more moving targets; further comprising: an operator input device coupled to said processor for manually selecting a particular one of said one or more moving targets.

2. The tracking system of claim 1 wherein said laser speed measurement system is operative to calculate a speed of a moving target.

3. The tracking system of claim 2 wherein said tracking system is mounted on a moving vehicle having a speed of said moving vehicle input to said tracking system through an onboard diagnostic port.

4. The tracking system of claim 3 further comprising:

a global positioning subsystem coupled to said processor, wherein said speed of said moving vehicle is periodically cross-checked or corrected based on speed data of said moving vehicle derived from said global positioning subsystem.

5. The tracking system of claim 1 wherein said processor is operative to correct for geometric errors or the cosine effect when tracking one or more moving targets.

6. The tracking system of claim 1 wherein said tracking system is mounted in a police vehicle.

7. The tracking system of claim 6 wherein said tracking system is mounted in a light bar of said police vehicle.

8. The tracking system of claim 1 wherein said pan/tilt subsystem further comprises:

a base plate;

a pan motor mounted to said base plate and operatively coupled to a panning plate;

a tilt motor mounted to said base plate and operatively coupled to a tilt plate;

first and second position sensors associated with said pan and tilt motors respectively for providing position information of said pan and tilt motors to said processor.

9. The tracking system of claim 8 wherein said visual sensor subsystem and said laser speed measurement subsystem are mounted to said tilt plate.

10. The tracking system of claim 1 wherein said pan/tilt subsystem further comprises:

a stabilization system.

11. The tracking system of claim 10 wherein said stabilization system further comprises:

a gyro.

12. The tracking system of claim 10 wherein said stabilization system further comprises:

an inclinometer or accelerometer.

13. The tracking system of claim 1 wherein said visual sensor subsystem further comprises:

a narrow view sensor; and a wide view sensor.

14. The tracking system of claim 13 wherein said narrow view and wide view sensors are operative concurrently to provide respective narrow and wide views of a target.

15. The tracking system of claim 1 further comprising:

an associated display device for displaying images of said one or more moving targets.

16. The tracking system of claim 15 wherein said display device further displays a speed of said one or more moving targets.

17. The tracking system of claim 15 wherein said display device further comprises:

a touch screen display for enabling an operator of said tracking system to select one of said one or more moving targets.

18. A system for monitoring the speed of one or more target vehicles comprising:

a processor a laser speed measurement subsystem coupled to said processor;

a visual sensor subsystem coupled to said processor; and a pan/tilt subsystem coupled to said processor and operative to autonomously track said one or more target vehicles based on input from said visual sensor subsystem, said system determining a speed of said one or more target vehicles based on input from said laser speed measurement subsystem a display device coupled to said processor for displaying images of said one or more target vehicles from said visual sensor subsystem; wherein said display device is further operative to display a speed of said one or more target vehicles; wherein said display device comprises a touch screen enabling an operator of said system to select a particular one of said one or more target vehicles for tracking by said system.

19. The system of claim 18 wherein said system is mounted in a moving vehicle.

20. The system of claim 19 wherein an onboard diagnostic port of said moving vehicle provides speed information of said moving vehicle to said processor.

21. The system of claim 20 further comprising:

a global positioning subsystem coupled to said processor operative to provide speed information of said moving vehicle to said processor.

22. The system of claim 18 wherein said system is mounted at a fixed position relative to said one or more target vehicles.

23. The system of claim 18 wherein said visual sensor subsystem comprises:

a narrow view sensor; and a wide view sensor.

24. The system of claim 23 wherein said narrow view and wide view sensors are operative concurrently to provide respective narrow and wide views of at least one of said one or more target vehicles.

25. The system of claim 24 wherein said narrow and wide views of said at least one of said one or more target vehicles are stored with a computed speed of said at least one of said one or more target vehicles for evidentiary purposes.

26. The system of claim 18 further comprising:

an onboard camera coupled to said processor for providing video data regarding an image and speed of said one or more target vehicles.

27. The system of claim 18 wherein said a pan/tilt subsystem further comprises:

a base plate;

a pan motor mounted to said base plate and operatively coupled to a panning plate;

a tilt motor mounted to said base plate and operatively coupled to a tilt plate;

first and second position sensors associated with said pan and tilt motors respectively for providing position information of said pan and tilt motors to said processor.

28. The tracking system of claim 27 wherein said visual sensor subsystem and said laser speed measurement subsystem are mounted to said tilt plate.

29. The tracking system of claim 18 wherein said pan/tilt subsystem further comprises:

a stabilization system.

30. The tracking system of claim 29 wherein said stabilization system further comprises:

a gyro.

31. The tracking system of claim 29 wherein said stabilization system further comprises:

an inclinometer or accelerometer.

32. The tracking system of claim 18 further comprising:

an input/output port coupled to said processor.

33. The tracking system of claim 32 wherein said input/output port is a wireless port.

34. The tracking system of claim 32 wherein said input/output port is a serial port.

* * * * *